US006705377B1

(12) United States Patent
Coolman

(10) Patent No.: US 6,705,377 B1
(45) Date of Patent: Mar. 16, 2004

(54) HORIZONTAL FOLDING DOOR SYSTEM

(76) Inventor: David W. Coolman, 13 Stone Clover Dr., Saratoga Springs, NY (US) 12866

( * ) Notice: Subject to any disclaimer, the term of this patent is extended or adjusted under 35 U.S.C. 154(b) by 0 days.

(21) Appl. No.: 10/269,668

(22) Filed: Oct. 12, 2002

(51) Int. Cl.[7] ..... E06B 3/48
(52) U.S. Cl. ..... 160/118; 160/199
(58) Field of Search ..... 160/199, 206, 160/118, 196.1, 117, 232, 183, 405

(56) References Cited

U.S. PATENT DOCUMENTS

| | | | | | |
|---|---|---|---|---|---|
| 1,357,299 | A | * | 11/1920 | Phillips | 160/118 |
| 1,463,346 | A | * | 7/1923 | Walker | 160/118 |
| 1,463,347 | A | * | 7/1923 | Walker | 160/118 |
| 2,747,200 | A | * | 5/1956 | Finkel | 160/206 |
| 3,435,877 | A | * | 4/1969 | Horton | 160/206 |
| 3,529,651 | A | * | 9/1970 | Bender | 160/183 |
| 4,269,254 | A | * | 5/1981 | Horton | 160/206 |
| 4,296,791 | A | * | 10/1981 | Chaumat et al. | 160/206 |
| 4,339,487 | A | * | 7/1982 | Mullet | 160/232 X |
| 6,470,952 | B1 | * | 10/2002 | Cline et al. | 160/118 X |

OTHER PUBLICATIONS

Photocopy of Prior Art Horizontal Folding Door.

* cited by examiner

*Primary Examiner*—David Purol
(74) *Attorney, Agent, or Firm*—Donald J. Ersler

(57) ABSTRACT

An improved horizontal folding door system includes a first folding door, a second folding door, a trolley track, and at least two trolleys. The improved horizontal folding door system covers a large door frame opening of an airplane hanger or some other building structure. Each folding door includes a first door section pivotally attached to a second door section. At least one trolley is attached to a top of each second door section. The trolley track is attached to a top of the door frame opening. The at least two trolleys ride in the trolley track. Each door section is pivotally attached to one side of the door frame opening and is slidably retained by at least one trolley. Preferably, at least two locking pins extend from each second door section to retain each second door frame in an closed or open position.

30 Claims, 6 Drawing Sheets

HORIZONTAL FOLDING DOOR SYSTEM

BACKGROUND OF THE INVENTION

1. Field of the Invention

The present invention relates generally to horizontal folding doors and more specifically to an improved horizontal folding door system, which provides increased rigidity when open.

2. Discussion of the Prior Art

The prior art includes at least two types of horizontal folding door systems. One type of horizontal folding door system includes two horizontal folding doors. Each horizontal folding door includes a plurality of folding door sections. The sections are approximately two feet in length. The plurality of folding door sections stack-up together, when closed. The drawback to this type of horizontal folding door system is that the plurality of folded door sections decrease the opening size. Another type horizontal folding door system includes two folding doors. Each folding door includes two folding door sections. The drawback to this type of horizontal folding door system is that the folding door sections are so large that they are subject to twisting. A sliding pivot point is formed on an end of a second door section, which makes the folding door unstable in an open position, during a wind gust.

Accordingly, there is a clearly felt need in the art for an improved horizontal folding door system, which provides increased rigidity when open, a maximum size door opening, and an improved locking system.

SUMMARY OF THE INVENTION

The present invention provides improved folding doors, which are more rigid when open than that of the prior art. An improved horizontal folding door system includes a first folding door, a second folding door, a trolley track, and at least two trolleys. The improved horizontal folding door system covers a large door frame opening for an airplane hanger or other building structure. The door frame includes a horizontal frame member terminated by a single vertical frame member on each end thereof. Each folding door includes a first door section and a second door section. One side of each first door section is pivotally attached to one vertical frame member and the other side of each first door section is pivotally attached to one side of a single second door section. The first door section preferably has a shorter length than the second door section. However, a door frame opening may also be covered with a single folding door instead of two.

The trolley track is attached to the horizontal frame member. At least one trolley is attached to a top of each second door section. Preferably, at least one locking pin extends from a top of each second door section and at least one locking pin extends from a bottom of each second door section. All the locking pins disposed on each second door section are preferably controlled by a single actuation device. A plurality of locking cavities must be formed in a floor of a building structure and a plurality of locking cavities are preferably formed in at least one overhead stud. A single locking cavity receives each locking pin.

Each door section preferably includes a bottom rail, two vertical rails and at least two horizontal girts. The bottom rail is terminated by a single vertical rail on each end thereof. Each vertical rail is structured to receive an end of the at least two horizontal girts. Each vertical rail is preferably structured to receive an end of a face plate. Reinforcing girts may be used to prevent the door sections from twisting. The reinforcing girts are retained in the two vertical rails. A second embodiment of each door section includes a front sheet, a rear sheet, a foam inner layer, and two end vertical rails. The front and rear sheets are retained, such that a space is created therebetween. Foam is blown into the space between the front and rear sheets to form a foam door section. A single vertical end rail is attached to each end of the foam door section.

Accordingly, it is an object of the present invention to provide an improved horizontal folding door system, which has increased rigidity when open.

It is a further object of the present invention to provide an improved horizontal folding door system, which has a maximum size door opening.

Finally, it is another object of the present invention to provide an improved horizontal folding door system, which has an improved locking system.

These and additional objects, advantages, features and benefits of the present invention will become apparent from the following specification.

DETAILED DESCRIPTION OF THE PREFERRED EMBODIMENTS

Figure 1:
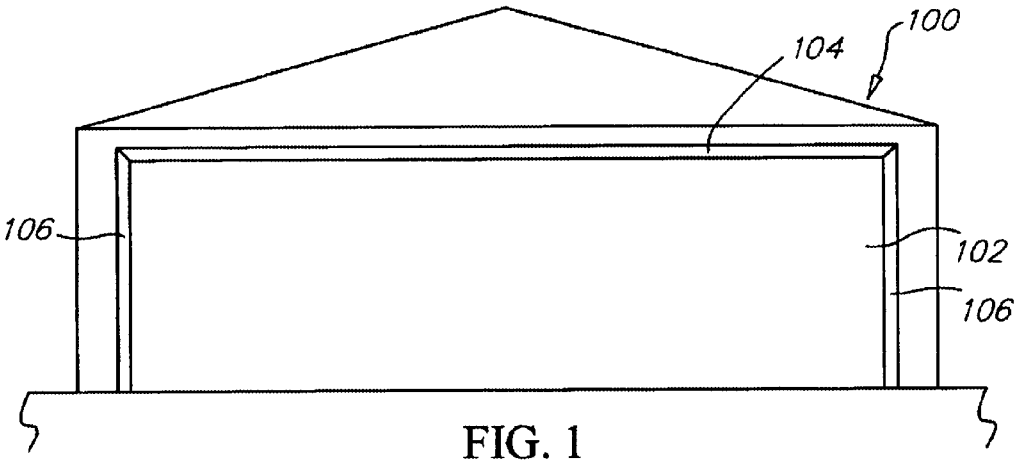
FIG. 1 is a front view of an airplane hanger with a door frame opening.
Figure 2:
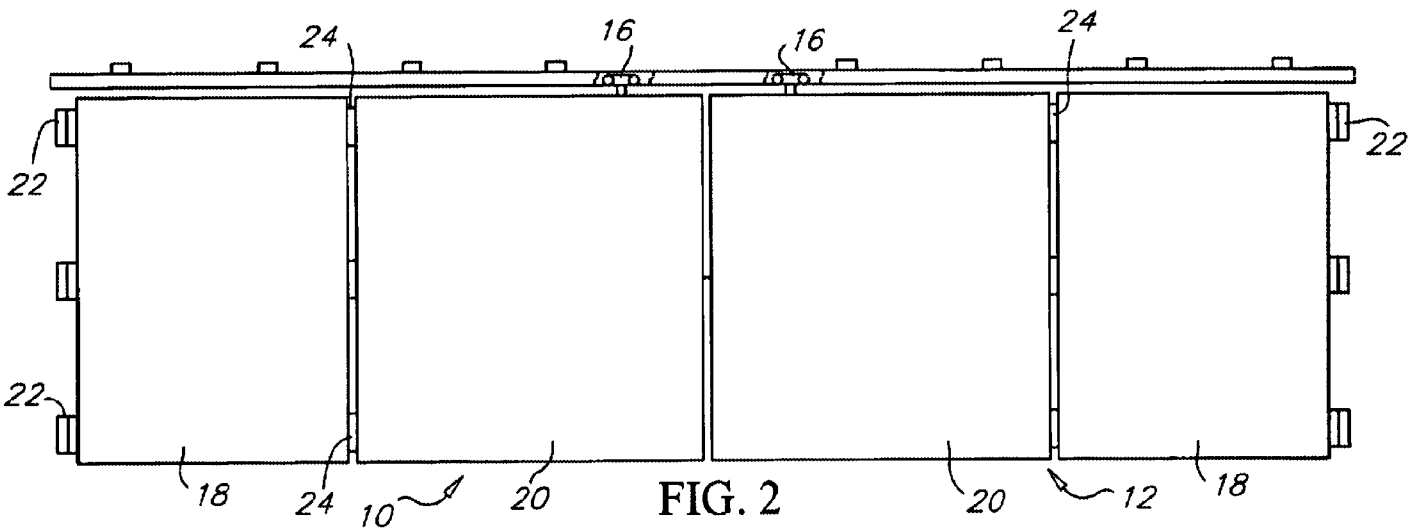
FIG. 2 is a front view of an improved horizontal folding door system in accordance with the present invention.
Figure 4:
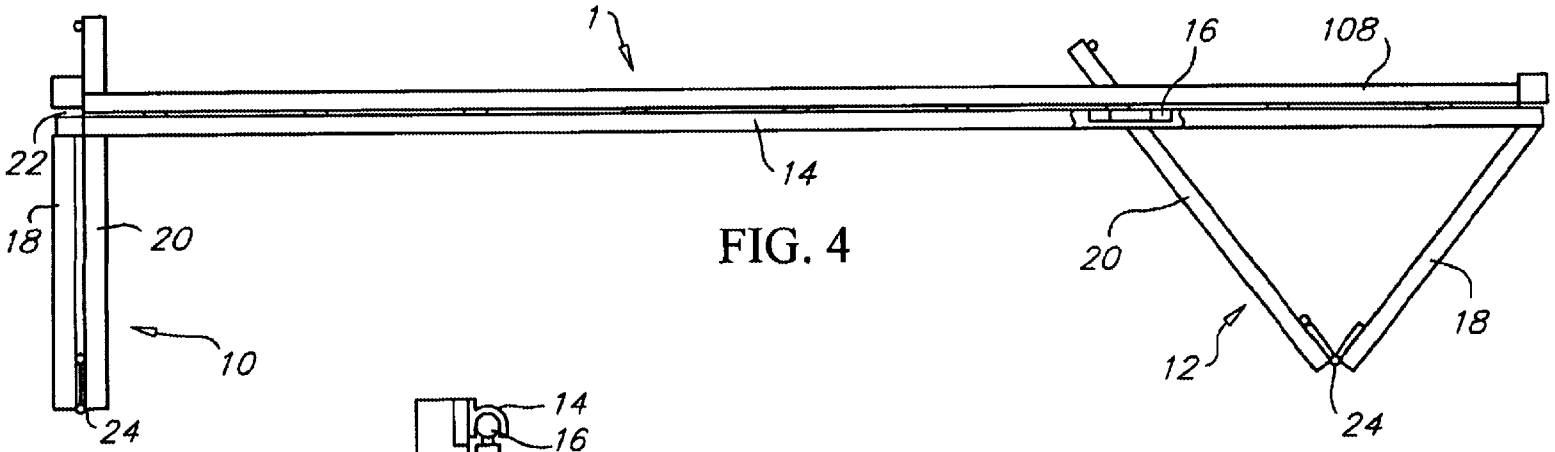
FIG. 4 is a top view of an improved horizontal folding door system in accordance with the present invention.
Figure 3:
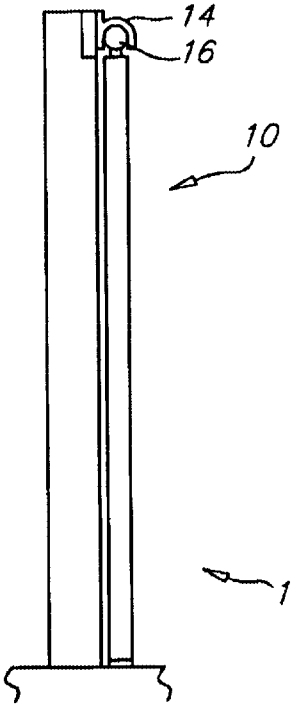
FIG. 3 is an end view of an improved horizontal folding door system in accordance with the present invention.

With reference now to the drawings, and particularly to FIG. 2, there is shown a front view of an improved horizontal folding door system 1. With reference to FIGS. 3 and 4, the improved horizontal folding door system 1 includes a first folding door 10, a second folding door 12, a trolley track 14, and at least two trolleys 16. With reference to FIG. 1, the improved horizontal folding door system 1 covers a door frame opening 102 of an airplane hanger 100 or other building structure. The door frame opening 102 includes a horizontal frame member 104 terminated by a single vertical frame member 106 on each end thereof.

Each folding door 10, 12 includes a first door section 18 and a second door section 20. One side of the first door 18 section is pivotally attached to one vertical frame member 106 with at least one hinge 22 (a single continuous hinge may be used). The other side of the first door 18 is pivotally attached to one side of the second door section 20 with at least one hinge 24. Preferably, the first door section 18 has a shorter length than the second door section 20. The shorter length of the first door section 18 relative to the second door section 20 enables a portion of the second door section 20 to be inside the structure, when open. However, a door frame opening may also be covered with a single folding door 10, 12 instead of two.

Figure 6:
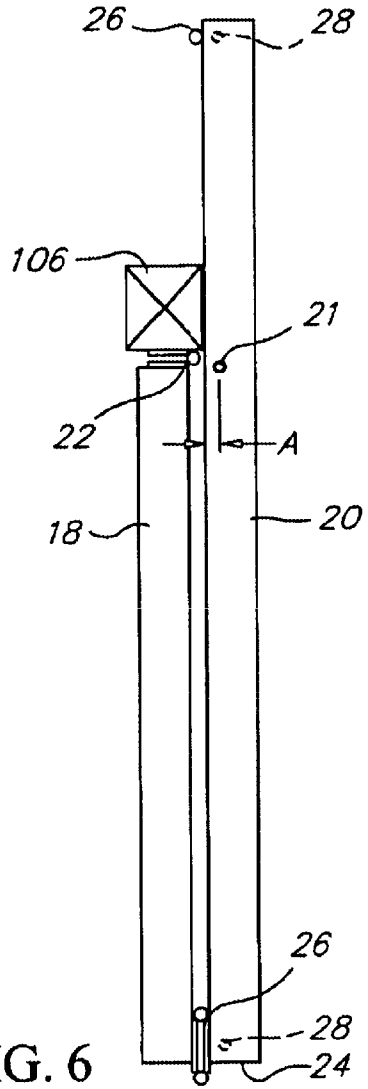
FIG. 6 is a top view of a first folding door of an improved folding horizontal door system in accordance with the present invention.

The trolley track 14 is attached to the horizontal frame member 104. At least one trolley 16 is attached to a top of each second door section 20 substantially at the other side thereof. With reference to FIG. 6, a trolley threaded hole 21 is, formed in a top of each second door section 20 to threadably receive a single trolley 16. The trolley threaded hole 21 is preferably spaced a distance "A" from an inside edge of the second door section 20. The distance "A" is less than thickness of the second door section 20. The trolley threaded hole 21 is also positioned along a length of the second door section 20; such that a portion of the second door section 20 is disposed inside the building structure, when the second door section 20 is fully open.

Figure 5A:
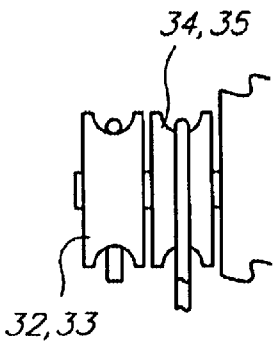
FIG. 5*a* is an end view of first and second pulleys used for retaining locking pin cables in an improved horizontal folding door system in accordance with the present invention.
Figure 5:
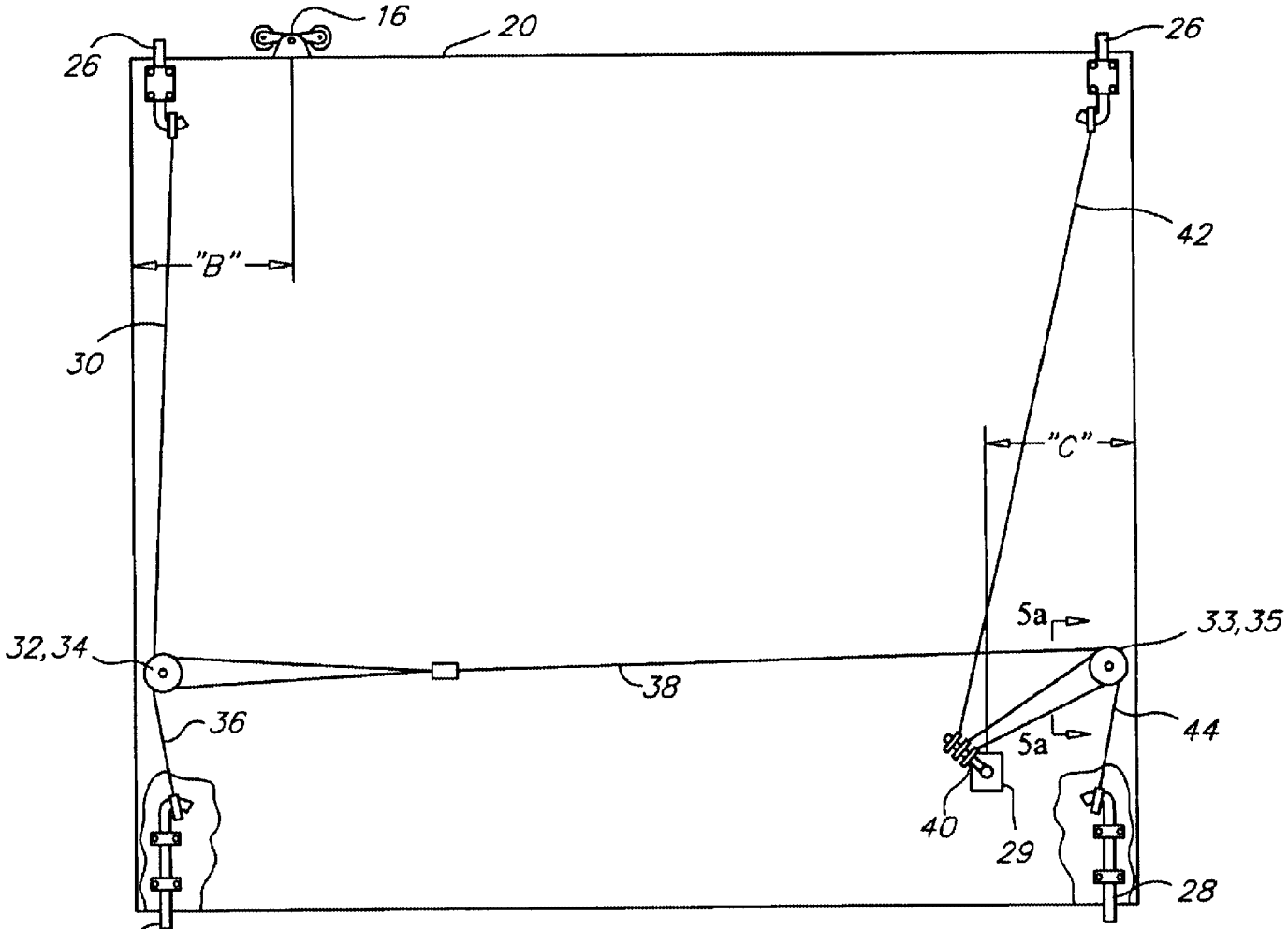
FIG. 5 is a rear view of a second folding door section of an improved horizontal folding door system with at least two locking pins in accordance with the present invention.

With reference to FIGS. 5 & 6, at least one top locking pin 26 extends from a top of each second door section 20 and at least one bottom locking pin 28 extends from a bottom of each second door section 20. The at least one top locking pin 26 is spring loaded, such that thereof is normally in an extended position. The at least one bottom locking pin 28 is preferably gravity actuated, but may be spring loaded. Locking pins are well known in the art and need not be explained in detail. All the locking pins disposed on each second door section 20 are preferably controlled by a single actuation device 29. The single actuation device 29 includes a rotation arm 40. The single actuation device is rotated with a handle or key (not shown) to pivot the rotation arm 40 and retract the locking pins 26, 28. With reference to FIG. 5, the single actuation device 29 is preferably located horizontally inward from the one side of the second door section 20, a dimension "C." A center of a single trolley 16 is preferably located horizontally inward from other side of the second door section 20, a dimension "B." Dimension "B" is preferably substantially equal to dimension "C." Locating the trolley 16 and the actuation device 29 as shown in FIG. 5, reduces the effort required to open the first and second folding doors. A portion of each second door section 20 is disposed inside the airplane hanger 100 or building structure when the first and second folding doors are fully open.

With reference to FIG. 5*a*, one of the top locking pins 26 is retracted by a first top cable 30 around a first pulley 32. One of the bottom locking pins 28 is retracted by a first bottom cable 36 around a second pulley 34. The first top and bottom cables are attached to one end of a lengthwise cable 38. The other end of the lengthwise cable 38 is attached to a rotation arm 40 around a second pulley 35. Another top locking pin 26 is retracted by second top cable 42, when the rotation arm 40 is pivoted. Another bottom locking pin 28 is retracted by a second bottom cable 44, when the rotation arm 40 is pivoted. The second bottom cable 44 is supported by the first pulley 33.

At least four bottom locking cavities (not shown) are formed in a floor of the airplane hanger 100 or other building structure. One set of bottom locking cavities would lock the first and second folding doors in a closed position and another set of bottom locking cavities would lock the first and second folding doors in an open position. At least two top locking cavities (not shown) are preferably formed in an overhead stud 108 for locking the first and second folding doors in a closed position. Another overhead stud (not shown) would be required to lock the first and second folding doors in an open position on a top thereof. A single locking cavity receives each locking pin. One set of top locking cavities lock the first and second doors in an open position and another set of top locking cavities lock the first and second doors in an open position.

Figure 8:
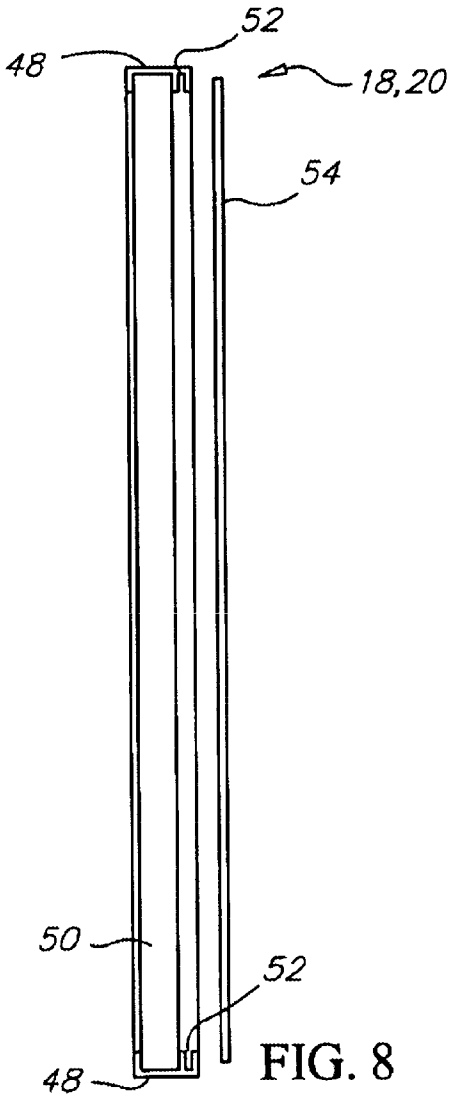
FIG. 8 is a top view of a structural folding door section without a front panel retained therein of an improved horizontal folding door system in accordance with the present invention.
Figure 7:
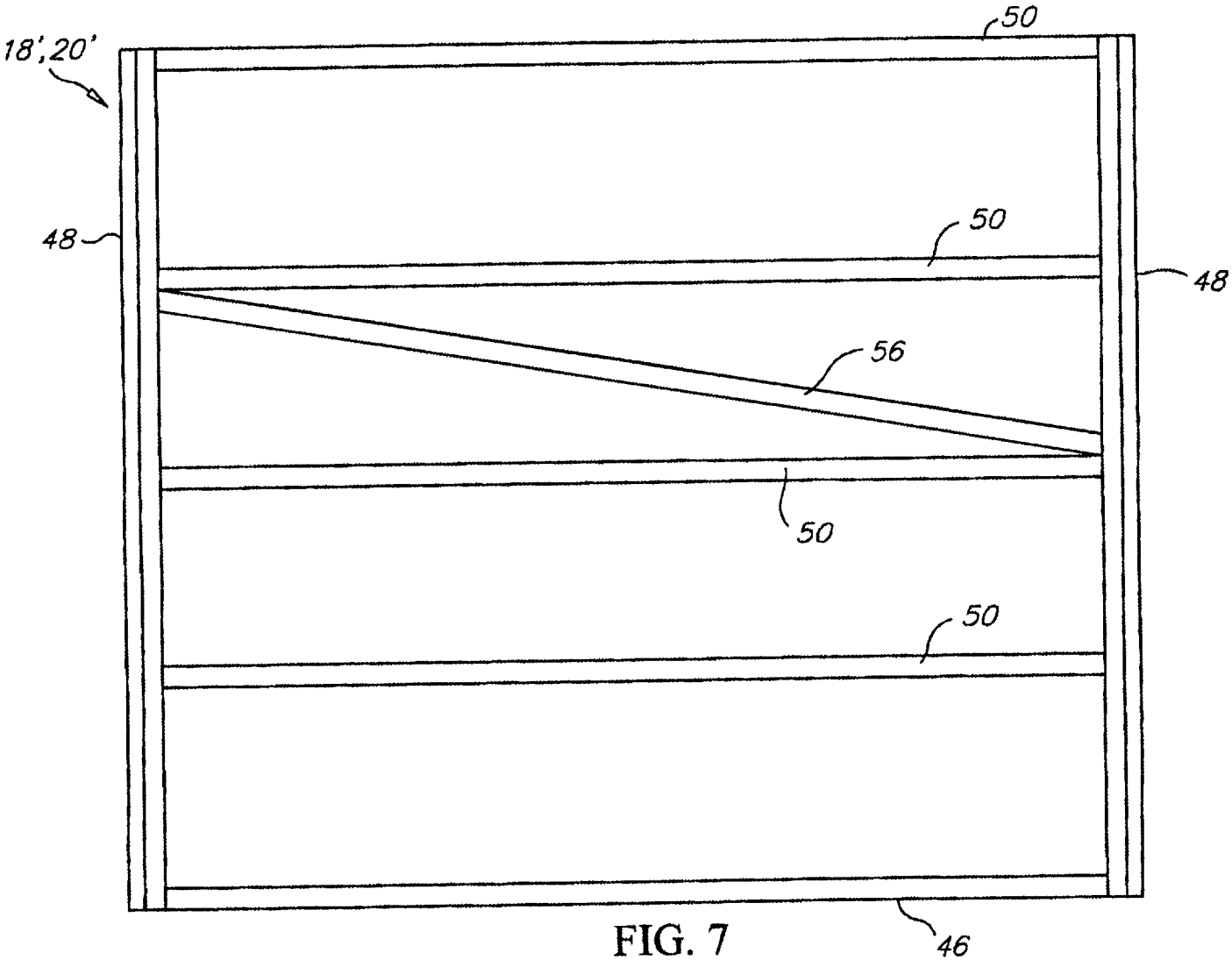
FIG. 7 is a front view of a structural folding door section without a front panel of an improved folding door system in accordance with the present invention.

With reference to FIGS. 7 & 8, each door section 18, 20 includes a bottom rail 46, two vertical rails 48 and at least two horizontal girts 50. The bottom rail 46 is terminated by a single vertical rail 48 on each end thereof. Each vertical rail 48 is structured to receive an end of the at least two horizontal girts 50. Each vertical rail 48 may include a retainer slot 52 which is sized to receive an end of a face plate 54. At least one reinforcing girt 56 may be used to strengthen each door section 18, 20 to prevent twisting. The at least one reinforcing girt 56 is retained in the two vertical rails 48, between two horizontal girts 50. Structural doors are well known in the art and need not be explained in detail.

Figure 9:
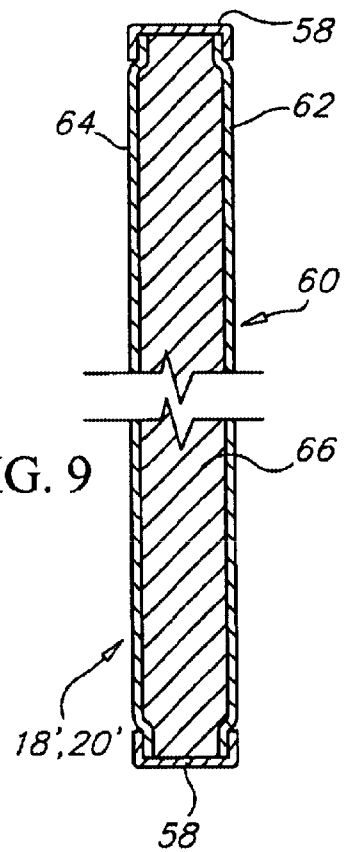
FIG. 9 is a top cross sectional view of a foam folding door section of an improved horizontal folding door system in accordance with the present invention.
Figure 10:
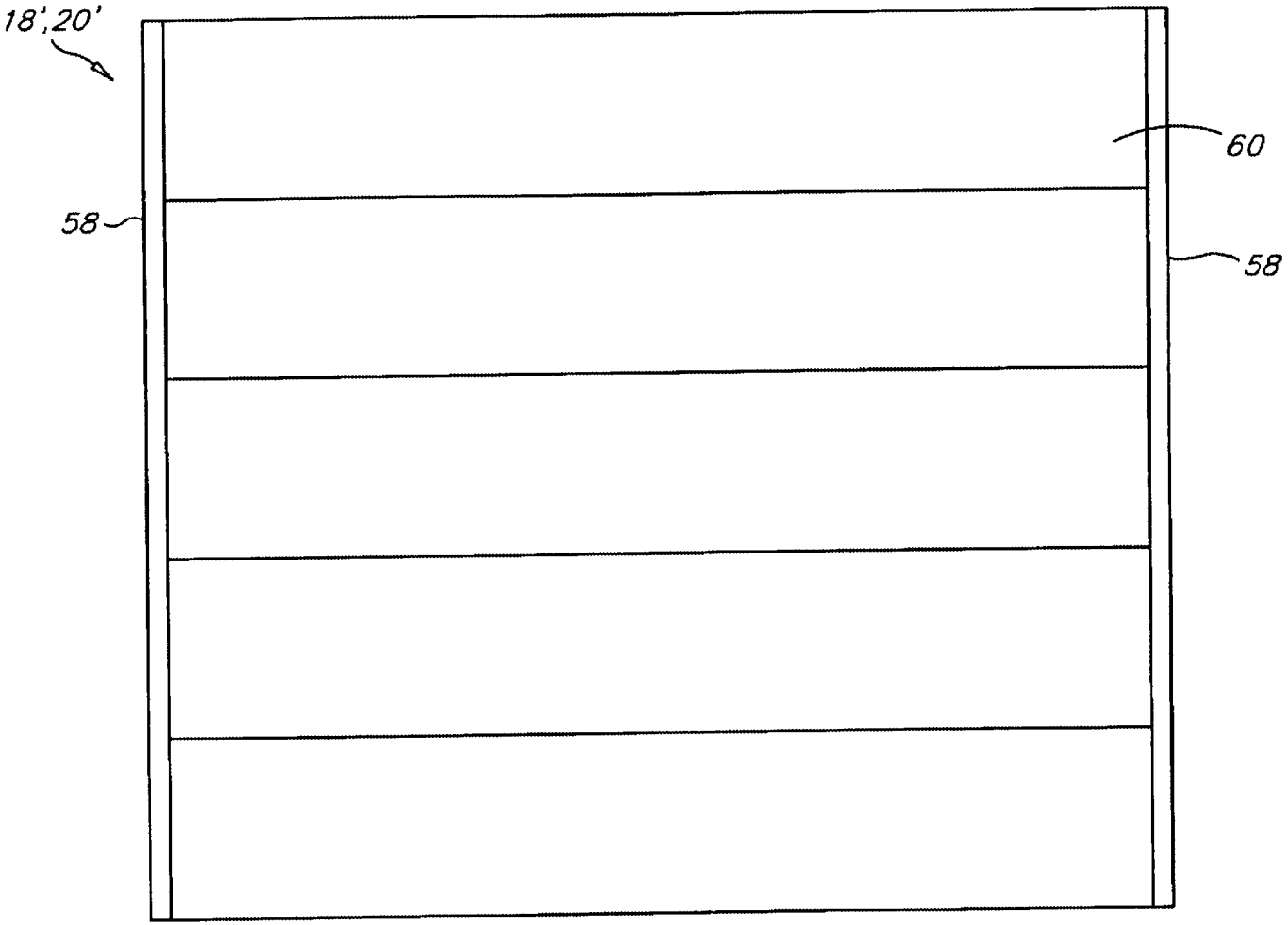
FIG. 10 is a front view of a foam folding door section of an improved horizontal folding door system in accordance with the present invention.

With reference to FIGS. 9 and 10, a second embodiment of each door section 18', 20' includes two vertical end rails 58 and at least one insert door section 60. Each insert door section 60 includes a front sheet 62, a rear sheet 64 and a foam inner layer 66. The front and rear sheets are retained, such that a space is created therebetween. The foam inner layer 62 is blown into the space between the front and rear sheets to form a single insert door section 60. A single vertical end rail 58 is attached to each end of the at least one insert door section 60.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A method of covering a door frame opening of a building structure with an improved horizontal folding door system, comprising the steps of:

providing a first folding door and a second folding door, each said folding door including a first door section pivotally attached to a second door section;

attaching pivotally one side of said first folding door to one side of said door frame, attaching pivotally one side of said second folding door to the other side of said door frame;

retaining slidably and pivotally a top of each said second door section relative to a top of said door frame, a portion of each said second door section being disposed inside said building structure when said first and second folding doors are fully open; and providing each said door section with a bottom rail, two vertical rails, at least two horizontal girts and a face plate, attaching a single vertical rail to each end of said bottom rail, attaching said at least two horizontal girts between said two vertical rails, attaching said face plate to said two vertical rails.

2. The method of covering a door frame opening of a building structure with an improved horizontal folding door system of claim 1, further comprising the step of:

providing each said second door section with a greater length than each said first door section.

3. The method of covering a door frame opening of a building structure with an improved horizontal folding door system of claim 1, further comprising the step of:

providing at least one locking pin disposed on a bottom of each said second door section, providing at least one locking pin disposed on a top of each said second door section.

4. The method of covering a door frame opening of a building structure with an improved horizontal folding door system of claim 3, further comprising the step of:

retracting each one of said at least two locking pins disposed on each said second door section with a single actuation device.

5. The method of covering a door frame opening of a building structure with an improved horizontal folding door system of claim 1, further comprising the step of:

attaching a trolley track to said top of said door frame, attaching at least one trolley to a top of each said second door section, said trolley track receiving at least one trolley.

6. The method of covering a door frame opening of a building structure with an improved horizontal folding door system of claim 3, further comprising the step of:

retracting said at least two locking pins with an actuation device, locating said actuation device substantially the same distance from one side of said second door section as one of at least one trolley is located from the other side of said second door section.

7. The method of covering a door frame opening of a building structure with an improved horizontal folding door system of claim 1, further comprising the step of:

attaching a reinforcing girt between two horizontal girts.

8. A method of covering a door frame opening of a building structure with an improved horizontal folding door system, comprising the steps of:

providing a folding door having a first door section pivotally attached to a second door section;

attaching pivotally one side of said first folding door to one side of said door frame;

retaining slidably and pivotally a top of said second door section relative to a top of said door frame, a portion of said second door section being disposed inside said building structure when said first and second folding doors are fully open; and providing each said door section with a bottom rail, two vertical rails, at least two horizontal girts and a face plate, attaching a single vertical rail to each end of said bottom rail, attaching said at least two horizontal girts between said two vertical rails, attaching said face plate to said two vertical rails.

9. The method of covering a door frame opening of a building structure with an improved horizontal folding door system of claim 8, further comprising the step of:

providing said second door section with a greater length than each said first door section.

10. The method of covering a door frame opening of a building structure with an improved horizontal folding door system of claim 8, further comprising the step of:

providing at least one locking pin disposed on a bottom of said second door section, providing at least one locking pin disposed on a top of said second door section.

11. The method of covering a door frame opening of a building structure with an improved horizontal folding door system of claim 10, further comprising the step of:

retracting each one of said at least two locking pins disposed on each said second door section with a single actuation device.

12. The method of covering a door frame opening of a building structure with an improved horizontal folding door system of claim 8, further comprising the step of:

attaching a trolley track to said top of said door frame, attaching at least one trolley to a top of each said second door section, said trolley track receiving at least one trolley.

13. The method of covering a door frame opening of a building structure with an improved horizontal folding door system of claim 10, further comprising the step of:

retracting said at least two locking pins with an actuation device, locating said actuation device substantially the same distance from one side of said second door section as one of at least one trolley is located from the other side of said second door section.

14. The method of covering a door frame opening of a building structure with an improved horizontal folding door system of claim 8, further comprising the step of:

attaching a reinforcing girt between two horizontal girts.

15. A method of covering a door frame opening of a building structure with an improved horizontal folding door system, comprising the steps of:

providing a first folding door and a second folding door, each said folding door including a first door section pivotally attached to a second door section;

attaching pivotally one side of said first folding door to one side of said door frame, attaching pivotally one side of said second folding door to the other side of said door frame;

retaining slidably and pivotally a top of each said second door section relative to a top of said door frame, a portion of each said second door section being disposed inside said building structure when said first and second folding doors are fully open; and providing each said door section with two vertical end rails and at least one insert door section, each one of said at least one insert door section including a front sheet, a rear sheet and a foam inner layer, retaining said front and rear sheets, such that a space is created therebetween, blowing said foam inner layer into the said space, terminating each end of said at least one insert door section with a single vertical end rail.

16. The method of covering a door frame opening of a building structure with an improved horizontal folding door system of claim 15, further comprising the step of:

providing each said second door section with a greater length than each said first door section.

17. The method of covering a door frame opening of a building structure with an improved horizontal folding door system of claim 15, further comprising the step of:

providing at least one locking pin disposed on a bottom of each said second door section, providing at least one locking pin disposed on a top of each said second door section.

18. The method of covering a door frame opening of a building structure with an improved horizontal folding door system of claim 17, further comprising the step of:

retracting each one of said at least two locking pins disposed on each said second door section with a single actuation device.

19. The method of covering a door frame opening of a building structure with an improved horizontal folding door system of claim 15, further comprising the step of:

attaching a trolley track to said top of said door frame, attaching at least one trolley to a top of each said second door section, said trolley track receiving at least one trolley.

20. The method of covering a door frame opening of a building structure with an improved horizontal folding door system of claim 17, further comprising the step of:

retracting said at least two locking pins with an actuation device, locating said actuation device substantially the same distance from one side of said second door section as one of at least one trolley is located from the other side of said second door section.

21. The method of covering a door frame opening of a building structure with an improved horizontal folding door system of claim 15, further comprising the step of:

attaching a reinforcing girt between two horizontal girts.

22. A method of covering a door frame opening of a building structure with an improved horizontal folding door system, comprising the steps of:

providing a folding door having a first door section pivotally attached to a second door section;

attaching pivotally one side of said first folding door to one side of said door frame;

retaining slidably and pivotally a top of said second door section relative to a top of said door frame, a portion of said second door section being disposed inside said building structure when said first and second folding doors are fully open; and providing each said door section with two vertical end rails and at least one insert door section, each one of said at least one insert door section including a front sheet, a rear sheet and a foam inner layer, retaining said front and rear sheets, such that a space is created therebetween, blowing said foam inner layer into the said space, terminating each end of said at least one insert door section with a single vertical end rail.

23. The method of covering a door frame opening of a building structure with an improved horizontal folding door system of claim 22, further comprising the step of:

providing said second door section with a greater length than each said first door section.

24. The method of covering a door frame opening of a building structure with an improved horizontal folding door system of claim 22, further comprising the step of:

providing at least one locking pin disposed on a bottom of said second door section, providing at least one locking pin disposed on a top of said second door section.

25. The method of covering a door frame opening of a building structure with an improved horizontal folding door system of claim 24, further comprising the step of:

retracting each one of said at least two locking pins disposed on each said second door section with a single actuation device.

26. The method of covering a door frame opening of a building structure with an improved horizontal folding door system of claim 22, further comprising the step of:

attaching a trolley track to said top of said door frame, attaching at least one trolley to a top of each said second door section, said trolley track receiving said at least one trolley.

27. The method of covering a door frame opening of a building structures with an improved horizontal folding door system of claim 24, further comprising the step of:

retracting said at least two locking pins with an actuation device, locating said actuation device substantially the same distance from one side of said second door section as one of at least one trolley is located from the other side of said second door section.

28. The method of covering a door frame opening of a building structure with an improved horizontal folding door system of claim 22, further comprising the step of:

attaching a reinforcing girt between two horizontal girts.

29. A method of covering a door frame opening of a building structure with an improved horizontal folding door system, comprising the steps of:

providing a first folding door and a second folding door, each said folding door including a first door section pivotally attached to a second door section;

attaching pivotally one side of said first folding door to one side of said door frame, attaching pivotally one side of said second folding door to the other side of said door frame;

retaining slidably and pivotally a top of each said second door section relative to a top of said door frame, a portion of each said second door section being disposed inside said building structure when said first and second folding doors are fully open;

providing each said door section with a bottom rail, two vertical rails, at least two horizontal girts and a face plate, attaching a single vertical rail to each end of said bottom rail, attaching said at least two horizontal girts between said two vertical rails, attaching said face plate to said two vertical rails; and attaching a reinforcing girt between two horizontal girts.

30. A method of covering a door frame opening of a building structure with an improved horizontal folding door system, comprising the steps of:

providing a folding door having a first door section pivotally attached to a second door section;

attaching pivotally one side of said first folding door to one side of said door frame;

retaining slidably and pivotally a top of said second door section relative to a top of said door frame, a portion of said second door section being disposed inside said building structure when said first and second folding doors are fully open;

providing each said door section with a bottom rail, two vertical rails, at least two horizontal girts and a face plate, attaching a single vertical rail to each end of said bottom rail, attaching said at least two horizontal girts between said two vertical rails, attaching said face plate to said two vertical rails; and attaching a reinforcing girt between two horizontal girts.

* * * * *